US010058121B2

(12) United States Patent
Sebastian et al.

(10) Patent No.: US 10,058,121 B2
(45) Date of Patent: Aug. 28, 2018

(54) BIODEGRADABLE CIGARETTE FILTER

(71) Applicant: R.J. Reynolds Tobacco Company, Winston-Salem, NC (US)

(72) Inventors: Andries D. Sebastian, Clemmons, NC (US); Alan B. Norman, Clemmons, NC (US); Leigh Ann Joyce, Lewisville, NC (US); Huamin Gan, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 497 days.

(21) Appl. No.: 14/737,009

(22) Filed: Jun. 11, 2015

(65) Prior Publication Data

US 2015/0272208 A1 Oct. 1, 2015

Related U.S. Application Data

(63) Continuation of application No. 12/963,275, filed on Dec. 8, 2010, now abandoned, which is a continuation-in-part of application No. 12/827,618, filed on Jun. 30, 2010, now abandoned.

(51) Int. Cl.

| | |
|---|---|
| ***A24D 3/06*** | (2006.01) |
| ***A24D 3/10*** | (2006.01) |
| ***A24D 3/02*** | (2006.01) |

(52) U.S. Cl.

CPC ..... *A24D 3/068* (2013.01); *A24D 3/0237* (2013.01); *A24D 3/0287* (2013.01); *A24D 3/064* (2013.01); *A24D 3/065* (2013.01); *A24D 3/10* (2013.01)

(58) Field of Classification Search

CPC .. B07B 9/02; B07B 4/08; B07B 11/06; A24D 3/068; A24D 3/10; A24D 3/0287; A24D 3/0237

See application file for complete search history.

(56) References Cited

U.S. PATENT DOCUMENTS

| | | | | |
|---|---|---|---|---|
| 6,174,603 | B1 | 1/2001 | Berger | |
| 6,344,239 | B1 | 2/2002 | Asai et al. | |
| 6,360,751 | B1 | 3/2002 | Fagg et al. | |
| 6,571,802 | B1 | 6/2003 | Yamashita | |
| 2005/0136155 | A1* | 6/2005 | Jordan et al. | B65D 65/466 426/77 |

FOREIGN PATENT DOCUMENTS

EP 1167589 A1 1/2002

OTHER PUBLICATIONS

R.R. Hegde, et al.; Bicomponent fibers; Apr. 2004; http://www.engr.utk.edu/mse/Textiles/Bicomponent%20fibers.htm.

J.S. Dugan; Novel properties of PLA fibers; 2001; www.fitfibers.com/files/PLA%20Fibers.doc.

* cited by examiner

*Primary Examiner* — Michael H. Wilson
*Assistant Examiner* — Dionne Walls Mayes
(74) *Attorney, Agent, or Firm* — Brinks Gilson & Lione

(57) ABSTRACT

A biodegradable bi-component fiber may include a polyhydroxyalkanoate and/or polylactic acid with cellulose acetate and/or plasticized cellulose acetate for use in a filter material configured for use in a filter of a smoking article. The bi-component fiber may have a sheath-core construction where one component of the bi-component forms the core, and the other component forms the sheath of each fiber. A filter made in accordance with this design may also include non-biodegradable material.

12 Claims, 2 Drawing Sheets

BIODEGRADABLE CIGARETTE FILTER

CROSS-REFERENCE TO RELATED APPLICATIONS

This application claims priority under 35 U.S.C. § 120 as a continuation of U.S. patent application Ser. No. 12/963,275, filed Dec. 8, 2010, which is a continuation-in-part of U.S. patent application Ser. No. 12/827,618, filed Jun. 30, 2010, each of which is incorporated herein by reference in its entirety.

TECHNICAL FIELD

The present invention relates to products made or derived from tobacco, or that otherwise incorporate tobacco, and are intended for human consumption. More particularly, the invention pertains to degradable filter compositions, including biodegradable compositions, for smoking articles such as cigarettes.

BACKGROUND

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod" or "tobacco rod." Normally, a cigarette has a cylindrical filter element aligned in an end-to-end relationship with the tobacco rod. Typically, a filter element comprises plasticized cellulose acetate tow circumscribed by a paper material known as "plug wrap." Certain filter elements can incorporate polyhydric alcohols. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette, until the tobacco rod is partially or completely consumed, after which the remaining cigarette portion is discarded.

The discarded portion of the cigarette rod typically is primarily composed of the filter element, although it may include most or all of a tobacco rod. In general, cigarette filters include solvent cross linked cellulose acetate fiber bundles wrapped in two layers of paper. The first layer of paper, often referred to as plug wrap, holds the fiber bundle together in a rod form and may include a glue line to anchor the fiber bundle to the plug wrap paper; the second layer, often referred to as the tipping, is fully adhered to the plug wrap and attaches the filter tube to the wrapping material surrounding the cigarette's tobacco rod. Cigarette filters may be slow to degrade or disperse in some environments. This is generally attributed to the tightly bound nature of the filter plug's design which is configured to provide a specified filtering effect, but which insulates the majority of the filter from certain environmental effects upon disposal.

The most commonly used polymer in cigarette filter manufacture is cellulose acetate that has a degree of acetate substitution of about 2.5 acetate groups per anhydroglucose unit group. During manufacture, the acetate polymer typically is extruded as a fiber tow, and mixed with one or more plasticizers (e.g., triacetin, polyethylene glycol, glycerin). Cellulose acetate tow processes are set forth, for example, in U.S. Pat. No. 2,953,838 to Crawford et al. and U.S. Pat. No. 2,794,239 to Crawford et al., which are incorporated by reference herein. After assembly of tow into filter-ready material, the plasticizers soften the fiber and enable inter-fiber bonds to form and harden a filter to a desired hardness/consistency. The surface chemistry of cellulose acetate and plasticizer provide for a smoke flavor that is widely desired and accepted by smokers. This may be due in part to their well-known ability to reduce naturally occurring phenolic compounds from tobacco smoke. Certain other filter designs/formulations may provide a different smoke flavor. To date, non-cellulose acetate tow filters have not generally been accepted nor met with commercial success.

A number of approaches have been used in the art to promote an increased rate of degradation of filter elements. One approach involves incorporation of additives (e.g., water soluble cellulose materials, water soluble fiber bonding agents, photoactive pigments, or phosphoric acid) into the cellulose acetate material in order to accelerate polymer decomposition. See U.S. Pat. No. 5,913,311 to Ito et al.; U.S. Pat. No. 5,947,126 to Wilson et al.; U.S. Pat. No. 5,970,988 to Buchanan et al.; and U.S. Pat. No. 6,571,802 to Yamashita. In some cases, conventional cellulose acetate has been replaced with other materials, such as moisture disintegrative sheet materials, extruded starch materials, polyhydroxybutyrate-co-hydroxyvalerate, or polyvinyl alcohol. See U.S. Pat. No. 5,709,227 to Arzonico et al; U.S. Pat. No. 5,911,224 to Berger; U.S. Pat. No. 6,062,228 to Loercks et al.; and U.S. Pat. No. 6,595,217 to Case et al.; and U.S. Pat. App. Pub. No. 2009/032037 to Xue et al. (which also discloses non-round cross-sectional geometries). Incorporation of slits into a filter element has been proposed for enhancing biodegradability, such as described in U.S. Pat. No. 5,947,126 to Wilson et al. and U.S. Pat. No. 7,435,208 to Garthaffner. U.S. Pat. No. 5,453,144 to Kauffman et al. describes use of a water sensitive hot melt adhesive to adhere the plug wrap in order to enhance biodegradability of the filter element upon exposure to water. U.S. Pat. No. 6,344,239 to Asai et al. proposes to replace conventional cellulose acetate filter elements with a filter element comprising a core of a fibrous or particulate cellulose material coated with a cellulose ester to enhance biodegradability.

Certain disposal environments may allow growth and proliferation of aerobic and/or anaerobic microorganisms. Although these microorganisms are not generally known to break down readily (i.e., biodegrade) the cellulose acetate fibers of traditional cigarette filters, it may be desirable to provide filters subject to biodegradability that also may provide a smoke flavor profile different from other biodegradable filter configurations. It may be desirable to provide filters that will biodegrade and/or otherwise degrade quickly.

BRIEF SUMMARY

A biodegradable fiber (including fiber tow) and/or biodegradable paper substrate may be coated with cellulose acetate and/or plasticized cellulose acetate for use in a filter material configured for application in a filter of a smoking article. A filter made in accordance with this design may also include non-biodegradable fiber, or fiber that degrades at different rates and/or under different conditions. Embodiments of cigarette filter compositions presented here may provide tow-forming and/or other fibers configured to be biodegradable in a variety of common disposal environments including, for example, landfills, private and industrial composting, open-air surfaces, aerobic, and/or anaerobic aquatic locations. In addition, the present embodiments may provide fiber surfaces modified to include acetate groups and conventional plasticizers to provide the smoke flavor commonly desired by smokers of filtered smoking articles such as cigarettes. Preferred embodiments may simultaneously provide both biodegradability and desirable flavor, which combination generally has seemed to elude the existing filter technologies.

Embodiments disclosed herein relate to a smoking article and associated methods, and in particular, a rod-shaped smoking article (e.g., a cigarette). The smoking article includes a lighting end (i.e., an upstream end) and a mouth end (i.e., a downstream end). A mouth end piece is located at the extreme mouth end of the smoking article, and the mouth end piece allows the smoking article to be placed in the mouth of the smoker to be drawn upon. The mouth end piece has the form of a filter element comprising a fibrous tow filter material. The fibrous tow filter material may incorporate an effective amount of a biodegradable material (or other degradable polymer material) configured for increasing the rate of degradation of the filter material upon disposal. This may include non-fibrous biodegradable material incorporated within the biodegradable tow. The degradable fibrous tow material described herein may further speed up and enhance degradation by allowing formation of voids within a filter formed from the fibrous tow as the degradable material decomposes, thus increasing available surface area within the fibrous tow for contact with the environment and/or microorganisms therein.

In one aspect a filter material and/or a filter used in a smoking article may include at least one segment of fibrous tow including a biodegradable material and a cellulose acetate coating and/or plasticized cellulose acetate coating disposed upon the biodegradable material. The cellulose acetate and/or plasticized cellulose acetate coating may be disposed on fiber surfaces of the fiber tow.

DETAILED DESCRIPTION

Figure 1:
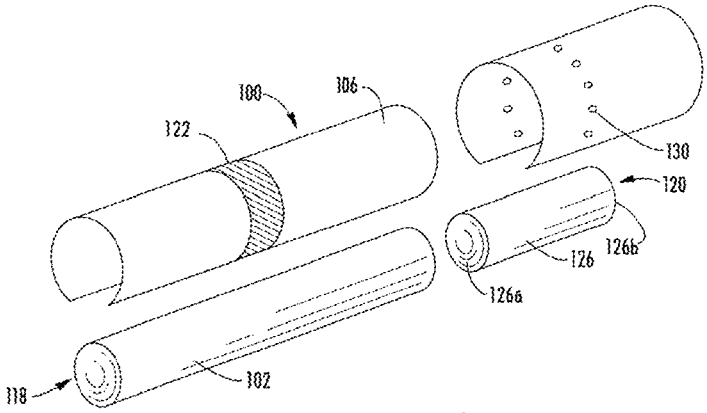
FIG. 1 is an embodiment of a smoking article.

Embodiments are described with reference to the drawings in which like elements are generally referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments of the present invention, such as—for example—conventional fabrication and assembly. As used in this specification and the claims, the singular forms "a," "an," and "the" include plural referents unless the context clearly dictates otherwise. As used herein, "fiber" is intended to include continuous and non-continuous or staple fibers (including for example monofilament fibers, fiber/fibrous tow, braided fibers, spun fibers, wound fibers, mono-component fibers, bi-component fibers, multi-component fibers, etc.), and each reference to any type of fiber should be considered generic except for those cases where one of skill in the art would recognize that the context is technically limited to a single fiber type.

As shown in FIG. 1, a smoking article 100 may be embodied as a cigarette. The cigarette 100 includes a generally cylindrical rod 102 of a charge or roll of smokable filler material contained in a circumscribing wrapping material 106. The rod 102 is conventionally referred to as a "tobacco rod." The ends of the tobacco rod 102 are open to expose the smokable filler material. The cigarette 100 is shown as having one optional band 122 (e.g., a printed coating including a film-forming agent, such as starch, ethylcellulose, or sodium alginate) applied to the wrapping material 106, and that band circumscribes the cigarette rod in a direction transverse to the longitudinal axis of the cigarette. That is, the band 122 provides a cross-directional region relative to the longitudinal axis of the cigarette. The band 122 can be printed on the inner surface of the wrapping material (i.e., facing the smokable filler material), or less preferably, on the outer surface of the wrapping material. Although the cigarette can possess a wrapping material having one optional band, the cigarette also can possess wrapping material having further optional spaced bands numbering two, three, or more.

A filter element 126 is disposed at the mouth end 120 of the tobacco rod 102, and the lighting end 118 is positioned at the opposite end. The filter element 126 is axially aligned in an end-to-end relationship with and preferably abutting the tobacco rod 102. Filter element 126 may have a generally cylindrical shape, and its diameter may be substantially the same as the diameter of the tobacco rod. The proximal and distal ends 126*a*, 126*b* (respectively) of the filter element 126 preferably permit the passage of air and smoke therethrough.

Embodiments of filters in the present disclosure include biodegradable polymers or other materials, which may be formed as fibers, and often be embodied in the form of tow fibers. A segment or at least one segment of at least one fiber (including a plurality of fibers up to all or substantially all fibers in a filter) may be coated with cellulose acetate and/or plasticized cellulose acetate. The polyhydroxyalkanoate (PHA) family of biodegradable polymers includes polyhydroxypropionate, polyhydroxyvalaerate, polyhydroxybutyrate, and polyhydroxyoctanoate. Other biodegradable polymers useful within the present invention include polylactic acid (PLA), polycaprolactones, polybutylene succinate adipate, polyvinyl alcohol (PVA), starch, polyesteramide, regenerated cellulose (e.g., rayon), and various aromatic copolyesters, and any combination of these polymers, blends of such biodegradable polymers, and non-biodegradable polymers such as starch-polyolefin mixtures. The fibers formed and coated may be configured as fibrous tow. Biodegradable paper material may also be used.

Preferred polymers will include a high degree of biodegradability, will be fibrillatable or fiber-forming and/or may generally be extruded to form tow or other fibers having sufficient strength to form cigarette filters (including during manufacture with standard or modified filter-making equipment known in the art). Preferred constructions—whether polymeric fiber or paper-based—preferably will include surface chemistries of coatings, including cellulose acetate based and/or plasticized cellulose acetate chemistries, that may provide a flavor profile for smokers that is substantially similar or even identical to that associated with traditional filter configurations. The substrates for the cellulose acetate and/or plasticized cellulose acetate coating may include a variety of other materials. For example, generally non-fibrous polymers and compositions such as paper compositions may also be coated with cellulose acetate for use, in keeping with the principles of the present invention. Similarly, biodegradable and/or non-biodegradable polypropylene filter tow fibers may be coated with cellulose acetate and/or plasticized cellulose acetate for use in a smoking article filter in keeping with the principles of the present invention.

Biodegradability may be related to the specific polymer type. For example, the PHAs are known to be degradable by both aerobic and anaerobic microorganisms, which may allow them to biodegrade in a broad variety of environments. Although PHAs are generally considered difficult to extrude as fibers alone, they may be formed into fibers of acceptable strength by mixing different PHA polymers or mixing PHA's with other polymers, such as—for example—PLA. As another example, PLA may be broken down through hydrolytic degradation, biodegradation, thermal degradation, and/or photodegradation, depending upon the environment and modifications performed on the polymer. As another example, polycaprolactone (PCL) is biodegradable, which property may be increased when it is mixed with starch.

Figure 2A:
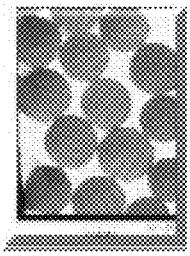
FIGS. 2A-2J show various multi-component fiber configurations.
Figure 2B:
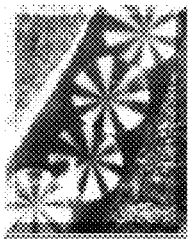
Figure 2C:
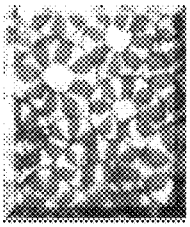
Figure 2D:
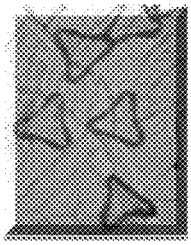
Figure 2E:
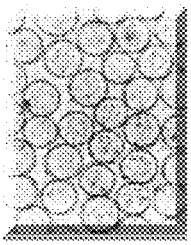
Figure 2F:
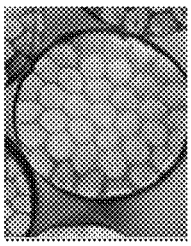
Figure 2G:
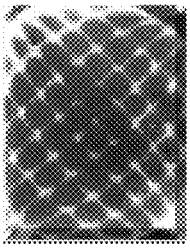
Figure 2H:
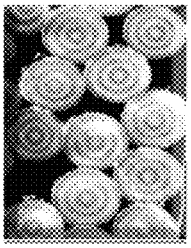
Figure 2I:
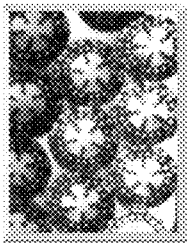
Figure 2J:
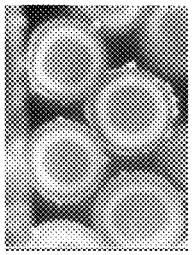

The tow fiber strength usually is determined by the extent of fiber draw during spinning, which is in turn related to the orientation of the polymer molecules during spinning of the fiber. Different biodegradable polymers may be mixed and used as a blend to make single component fibers having desirable crystallization and drawing properties. In certain processes, the polymers may be mixed to generate bi-component or other multi-component fibers. A variety of bi-component fibers may be used, including in the manufacture of smoking article filters, within the scope of the present invention. Bi-component fibers are formed using two polymers (e.g., polymer A, and polymer B). As shown in the cross-sectional views of FIGS. 2A-2J, the fiber components may be distributed in a variety of ways including, for example, striped (FIG. 2A), segmented pie (FIGS. 2B-2C), trilobal (FIG. 2D), sheath-core (FIG. 2E), "islands in the sea" (FIGS. 2F-2G, with the number of "islands" ranging from 37-64 as shown, to 600 or more), concentric ring fiber (FIG. 2H), snowflake fiber (FIG. 2I), and/or sheath-sheath-core (FIG. 2J) configurations. As shown herein, preferred fibers may be generally cylindrical in geometry, having a round, oval, elliptical, or other rounded outer geometry, however other cross sectional shapes such as Y-cross-section, and 4DG™, and any other shaped fibers may be used. (4DG™ is a fiber configuration that includes deep grooves or channels along the longitudinal axis of the fiber, providing for capillary movement of fluids and a large surface area relative to bulk as compared to columnar fibers). One example of useful bi-component fiber is a PHA/PLA composition disclosed in U.S. Pat. No. 6,905,987 to Noda, which is incorporated herein by reference.

In certain embodiments, a biodegradable filter material may include at least one bi-component fiber. The at least one bi-component fiber may include a polyhydroxyalkanoate and polylactic acid, and the cellulose acetate and/or plasticized cellulose acetate based coating will most preferably be disposed upon at least one surface of the at least one bi-component fiber. Each of the filter material embodiments described herein may be configured for inclusion in a filter for a smoking article such as a cigarette. Each of them most may be configured for treatment with a plasticizing agent to aid in forming a filter. When embodied as a multicomponent fiber, a fiber material configuration may be selected from the group consisting of striped, segmented pie, trilobal, sheath-core, "islands in the sea," concentric ring fiber, snowflake fiber, and sheath-sheath-core configurations. In certain embodiments, a filter material may include at least one multi-component element such as—for example—a bicomponent fiber, which includes at least two biodegradable materials with plasticized cellulose acetate coating disposed upon at least one surface of the at least one multi-component element As is known in the art with using biodegradable and other fibers, the ratios of fiber-forming polymer mixtures may be varied to attain a balance of desirable biodegradability properties and fiber strength. The ratio of polymer A to polymer B may range from about 90:10 to about 10:90, depending upon the fiber components selected. For example, U.S. Pat. No. 6,905,987 to Noda et al. describes PLA/PHA biodegradable bicomponent fibers where the PLA content may be varied from 10-90% of the weight of the fiber. PCT Publ. No. WO 96/25538 to Nakajima et al. (which is incorporated herein by reference) describes rapidly biodegradable synthetic fibers containing mixtures of 30-70% starch type polymers and other polymers such as PHA's, PLA, caprolactones etc. It is known that PHA polymer properties may be adjusted by mixing different PHA types to get required properties, such as—for example—a mixture of poly (3 hydroxybutyrate-co-4 hydroxyvalerate) in the percent ratio 84/16, which has properties similar to the well-known fiber forming polymer polypropylene (see, e.g., Akaraonye et al, J. Chem. Techol Biotechnol 2010; 85: 732-743).

In certain embodiments, melt-extruded single-component fibers made from PLA may be useful, as they are known to undergo ready degradation under, for example, controlled municipal composting conditions. Use of single-component PLA fibers may pose some challenges, as filter tow formed from them may not have a similar hardness as compared to cellulose acetate tow, when processed on conventional filter-making machinery. However the degradability advantages of PLA may be utilized by incorporating it into bi-component fiber such as, for example, a sheath-core bi-component fiber. In such a fiber, the core may be formed from a higher melting temperature PLA (e.g., 170° C. melting point), while the sheath may be formed of a lower melting temperature PLA (e.g., 120° C. melting point). In certain embodiments, the core may form a majority of the bi-component fiber. In one example, the core may make up at least about 80% by volume of the fiber, while the outer sheath makes up about 20%. The core may make up at least about 60% to about 95% by volume of the bi-component fiber. This construction enables a hardening step wherein the outer sheath is made to harden by being subjected to a heat above its melting point but below the melting point of the core, such that the outer sheath may act as a plasticizer (e.g., as it may interact with adjacent sheaths after the heating step to provide a desirable hardness).

In another embodiment, a PLA bi-component fiber may be formed with triacetin or another plasticizer incorporated into the outer sheath, which may reduce the melt-processing temperature. In yet another embodiment, a PLA bi-component fiber may be formed with cellulose acetate or other cellulose esters incorporated into the outer sheath (e.g., in powdered or other form(s)), which may reduce the melt-processing temperature. In cellulose ester embodiments, it may be preferable to control the cellulose ester content to a level that will not decrease degradability. The presence of cellulose acetate may allow plasticization of the fibers with triacetin or another plasticizer. It should be appreciated that other bi-component fibers may be formed with a core having a higher melt temperature than a sheath around the core, and that the sheath and core may include the same or different materials. Preferred bi-component fibers of this type made in accord with principles of the present invention generally may include a high level, and more typically a majority by volume, of materials that are readily degradable as described elsewhere herein—whether used alone or in combination with cellulose esters or other materials. A filter material, a filter made using the filter material, and or a smoking article using the filter material may include at least one bi-component fiber having a with a core having a higher melt temperature than a sheath around the core, where the sheath and core may include the same or different materials.

A water soluble cellulose acetate polymer or water insoluble cellulose acetate based dispersion (that may include plasticized cellulose acetate) may be applied to the biodegradable or otherwise degradable fibers described herein. A preferred coating for coating fiber tow to be used in cigarette filters according to embodiments of the present invention may have about 0.5 to about 1.2 acetyl substitution per unit of anhydroglucose group of the cellulose acetate polymer. Preferred cellulose acetate polymers suitable for fiber coatings are described in U.S. Pat. No. 4,983,730 to Domeshek et al., which is incorporated herein by reference, where such compositions comprise a 85-98 weight % of a low molecular weight water soluble cellulose acetate polymer having a solution viscosity from 5-50 cps and from 2-15 weight % of a higher molecular weight water soluble acetate polymer with a solution viscosity of greater than 100. Specifically, these polymers form clear, strong, flexible films that can easily be dried at room temperature. Cellulose acetate polymers having these characteristics are known in the art to be water soluble, and to function very well as film-forming agents. See, for example Wheatley (2007) in "Water Soluble Cellulose Acetate: A Versatile Polymer for Film Coating"; *Drug Development, and Industrial Pharmacy,* 33:281-90, Other water soluble polymers containing acetate functionality may be employed such as cellulose acetate phthalate and cellulose acetate mellitate. For these polymers the water solubility is dependent on the degree of phthalate or mellitate substitution, the pH, as well as the molecular weight.

Water insoluble cellulose acetate polymer dispersions may include, for example, cellulose acetate phthalate, cellulose acetate succinate, cellulose acetate butyrate, and/or cellulose acetate mellitate polymers that may be formulated as aqueous dispersions. One such dispersion is commercially available as Aquacoat® CPD Cellulose acetate phthalate dispersion (available from FMC Biopolymer). Plasticized cellulose acetate generally has thermoplastic properties and may best be applied to underlying polymeric, paper, or other substrates through any coating process known or developed for compositions with its physical properties. For example, plasticized cellulose acetate may be co-extruded with one or more biodegradable polymeric substrates to form the fibers described herein. It may be printed, coated, or otherwise applied to paper substrates.

During a method of making a coated fiber, water soluble cellulose acetate polymer or water insoluble cellulose acetate dispersions may be used as a fiber finish/coating. The phrase "solution or dispersion" should be clearly understood as including any aqueous mixture where cellulose acetate is water soluble (a solution), where it is generally or substantially insoluble (a dispersion), and any combination thereof (e.g., for aqueous mixtures containing both water-soluble and water-insoluble cellulose acetate(s)). For example, a cellulose acetate composition may be selected or adapted from compositions described in U.S. Pat. No. 4,983,730, which is incorporated by reference herein. The polymer concentration in this aqueous solution may be from about 0.5% to about 50% by weight. This solution may provide for application to, and formation of a cellulose acetate film around, the surface of the fiber. The resulting cellulose acetate coated fiber may have surface chemistries similar to the currently-used cellulose acetate fiber tow, but may be significantly more biodegradable. It may also allow conventional tow-plasticizers to be applied to generate desired filter hardness. The surfaces in a filter formed therefrom may have a surface chemistry similar to that of a traditional cellulose acetate fiber tow filter, and may provide a similar interaction with mainstream aerosol that most preferably may not adversely affect a smoker's perception of the flavor while smoking a cigarette incorporating a filter embodiment as described herein.

In one method of manufacturing coated fibers, PLA fibers may be formed in a standard manner by spinning. However, during the spinning process, an aqueous coating of cellulose acetate aqueous solution (as described above) may be applied in a manner known in the art, such as is used to apply lubricant or other coatings used in other PLA fiber manufacturing processes, and dried. After drying, the coated PLA fibers may be plasticized with a conventional or other plasticizing agent such as, for example, triacetin. Alternatively, the plasticizer may be added along with the cellulose acetate solution then dried. This method may be used with PHAs, PVA, and other biodegradable fiber-forming polymers discussed herein. The resulting filter will include cellulose acetate-coated biodegradable fibers. The majority surface area may be similar to traditional cellulose acetate filters. With PLA or other biodegradable polymers, a PLA fiber core may be coextruded with a plasticized cellulose acetate sheath.

In another method, fiber tow made by a standard spinning process from a biodegradable polymer (such as, for example, a bi-component PHA+PLA fiber tow) may be provided in a traditional fiber tow web. A filter-making machine of the type known in the art (e.g., such as, for example, the AF-KDF4 available from Hauni Maschinenbau AG) may be modified to apply and dry a cellulose acetate solution with a plasticizer using the same or complementary nozzles. The resulting filter may include cellulose acetate-coated biodegradable fibers. The majority surface area may be similar to traditional cellulose acetate filters.

In another embodiment, a film may be formed from one or more biodegradable polymers (including, for example, any of the polymers discussed herein or technically appropriate combinations thereof). The film may be formed by any of the standard polymer-processing methods used in forming such polymers into film, most preferably with the polymeric structure oriented to make the film readily fibrillatable. Specifically, the film formed may be subject to a film orientation step during formation to orient the molecular structure of the component polymer(s). The resulting film preferably may have sufficient tensile strength for fibrillation. The film may be treated with a cellulose acetate solution with a standard film-coating process, then subjected to fibrillation to form cellulose acetate-coated fibers. Alternatively, or in addition, the fibers may be coated with a cellulose acetate solution after fibrillation. In each of these and the other applications or embodiments, the cellulose acetate may be embodied as plasticized cellulose acetate. That is, the cellulose acetate may have been plasticized with triacetin or another plasticizing agent before being applied to the polymer fiber, fibers, paper, or other biodegradable substrate configured for use within principles of the present invention. For fibrillatable or fiber-forming polymers, it may be preferable to form the polymeric fibers before applying plasticized cellulose acetate.

A filter material of the present invention may include at least one fiber incorporating a biodegradable polymer selected from the group consisting of polyhydroxypropionate, polyhydroxyvalaerate, polyhydroxybutyrate, polyhydroxyoctanoate, polylactic acid, polycaprolactone, polybutylene succinate adipate, polyvinyl alcohol, starch, and polyesteramide, or their mixtures, wherein the at least one fiber includes a coating of cellulose acetate. In one aspect, a method of making such a fiber material may include steps of: forming a fiber from at least one biodegradable polymer selected from that group; coating the fiber with a solution or dispersion of cellulose acetate (and/or coating the fiber with plasticized cellulose acetate); and drying the fiber. In certain embodiments, the coated fiber may include one or more of the biodegradable materials discussed herein. In certain other embodiments, the coated fiber may consist of, consist essentially of, or include a majority composition of (i.e., consist mostly of), one or more of the biodegradable materials discussed herein.

A solution of cellulose acetate may be embodied as an aquatic solution of water-soluble cellulose acetate, where the cellulose acetate has a degree of acetyl substitution of about 0.5 to about 1.2. The solution of cellulose acetate may be embodied as an aquatic solution of water-soluble cellulose acetate, where such compositions comprise a 85-98 weight % of a low molecular weight water soluble cellulose acetate polymer having a solution viscosity from 5-50 cps and from 2-15 weight % of a higher molecular weight water soluble acetate polymer with a solution viscosity of greater than 100. If the film-forming fiber finish is a cellulose acetate based aqueous dispersion such as cellulose acetate phthalate or cellulose acetate mellitate, an appropriate amount of the dispersions may be used to form a uniform film on the fiber surface.

In another embodiment, a biodegradable fiber produced by above-described methods may be mixed with conventional cellulose acetate fibers to provide a fiber mixture. A filter formed in this manner may have a different biodegradability profile than a filter where at least one biodegradable fiber is coated, a plurality of biodegradable fibers is coated, or substantially all biodegradable fibers are coated, but may provide for a desirable flavor profile. Such embodiments may provide for improved dispersability of the cellulose acetate fibers which may enhance their ability to degrade and may lessen or even minimize the congestion and/or accumulation of cellulose acetate associated with existing cellulose acetate filters.

In other embodiments, the filter substrate may include a paper composition or other paper material, such as those known in the art or developed for use in filters of smoking articles. Use of paper filter substrates may be associated with a certain flavor profile. A different flavor profile may be provided for smoking articles by utilization of paper substrate in accordance with the present invention. The paper may be treated with cellulose acetate and/or plasticized cellulose acetate. In certain preferred embodiments, the paper substrate may be a biodegradable material. The treatment of the substrate with cellulose acetate and/or plasticized cellulose acetate may be done in one of several ways. For example, the treatment may be done by dipping, spraying, and/or printing (e.g., gravure printing) the cellulose acetate and/or plasticized cellulose acetate onto the substrate. Particularly when the substrate is a biodegradable paper material configured for use in a filter, it may be desirable to apply plasticized cellulose acetate by a gravure printing process and/or by a hot-melt process (as is known in the art to apply generally thermoplastic material to paper or other substrates).

A filter material formed by these or other methods may be assembled into a filter configured for a smoking article, including that it may be treated with one or more plasticizing agents. The step of forming a fiber from at least one biodegradable polymer may include an extrusion process, during—or after—which the cellulose acetate solution/dispersion may be applied. In one embodiment, the fiber material formed may include at least one polyhydroxyalkanoate and polylactic acid. A filter material configured for use as part of a smoking article may include a plurality of fibers and or paper composition, at least one of which includes a biodegradable material, where cellulose acetate and/or plasticized cellulose acetate is provided on at least one fiber and/or paper composition. Each of the filter materials and combinations thereof may be assembled into a filter 126 of the type known and used in smoking articles such as—for example—the cigarette 100 shown in FIG. 1. Other smoking article configurations such as, for example, in Eclipse® brand cigarettes, cigarillos, and/or other smoking articles may incorporate filter materials and filters of the present invention.

A ventilated or air diluted smoking article can be provided with an optional air dilution means, such as a series of perforations 130, each of which extend through the tipping material and plug wrap. The optional perforations 130, shown in FIG. 1, may be made by various techniques known to those of ordinary skill in the art, such as laser perforation techniques. Alternatively, so-called off-line air dilution techniques can be used (e.g., through the use of porous paper plug wrap and pre-perforated tipping paper). For cigarettes that are air diluted or ventilated, the amount or degree of air dilution or ventilation can vary. Frequently, the amount of air dilution for an air diluted cigarette may be greater than about 10 percent, generally may be greater than about 20 percent, and sometimes is greater than about 40 percent. The upper level for air dilution for an air diluted cigarette may be less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette.

During use, the smoker typically lights the lighting end 118 of the cigarette 100 using a match or cigarette lighter, whereupon the smokable material 102 begins to burn. The mouth end 120 of the cigarette 100 is placed in the lips of the smoker. Thermal decomposition products (e.g., components of tobacco smoke) generated by the burning smokable material 102 are drawn through the cigarette 100, through the filter element 126, and into the mouth of the smoker. Following use of the cigarette 100, the filter element 126 and any residual portion of the tobacco rod 102 may be discarded.

The dimensions of a representative cigarette 100 may vary. Preferred cigarettes are rod-shaped, and can have diameters of about 7.5 mm (e.g., circumferences of about 20 mm to about 27 mm, often about 22.5 mm to about 25 mm); and can have total lengths of about 70 mm to about 120 mm, often about 80 mm to about 100 mm. The length of the filter element 30 can vary. Typical filter elements can have total lengths of about 15 mm to about 40 mm, often about 20 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

Various types of cigarette components, including tobacco types, tobacco blends, top dressing and casing materials, blend packing densities and types of paper wrapping materials for tobacco rods can be employed. See, for example, the various representative types of cigarette components, as well as the various cigarette designs, formats, configurations and characteristics, that are set forth in Johnson, Development of Cigarette Components to Meet Industry Needs, 52nd T.S.R.C. (September, 1998); U.S. Pat. No. 5,101,839 to Jakob et al.; U.S. Pat. No. 5,159,944 to Arzonico et al.; U.S. Pat. No. 5,220,930 to Gentry and U.S. Pat. No. 6,779,530 to Kraker; U.S. Pat. Publication Nos. 2005/0016556 to Ashcraft et al.; 2005/0066986 to Nestor et al.; 2005/0076929 to Fitzgerald et al.; 2006/0272655 to Thomas et al.; 2007/0056600 to Coleman, III et al.; and 2007/0246055 to Oglesby, each of which is incorporated herein by reference. Most preferably, the entire smokable rod is composed of smokable material (e.g., tobacco cut filler) and a layer of circumscribing outer wrapping material.

The filter material can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary or fibrous tow such as cellulose acetate, polyolefins such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference.

Normally a plasticizer such as triacetin or carbowax is applied to the filamentary tow in traditional amounts using known techniques. In one embodiment, the plasticizer component of the filter material comprises triacetin and carbowax in a 1:1 ratio by weight. The total amount of plasticizer is generally about 4 to about 20 percent by weight, preferably about 6 to about 12 percent by weight. Other suitable materials or additives used in connection with the construction of the filter element will be readily apparent to those skilled in the art of cigarette filter design and manufacture. See, for example, U.S. Pat. No. 5,387,285 to Rivers, which is incorporated herein by reference.

Filamentary tow, such as cellulose acetate, is processed using a conventional filter tow processing unit such as a commercially available E-60 supplied by Arjay Equipment Corp., Winston-Salem, N.C. Other types of commercially available tow processing equipment, as are known to those of ordinary skill in the art, may similarly be used.

The filter elements disclosed herein may include a plurality of longitudinally-extending segments. Each segment may have varying properties and may include various materials capable of filtration or adsorption of particulate matter and/or vapor phase compounds. Typically, a filter element of the invention may include 1 to 6 segments, and frequently may include 2 to 4 segments. One or more of the segments may include one or more of the biodegradable and/or otherwise degradable components discussed herein, and may be coated with cellulose acetate.

Biodegradability can be measured, for example, by placing a sample in environmental conditions expected to lead to decomposition, such as placing a sample in water, a microbe-containing solution, a compost material, or soil. The degree of degradation can be characterized by weight loss of the sample over a given period of exposure to the environmental conditions. Preferred rates of degradation for certain filter element embodiments of the invention will include a weight loss of at least about 20% after burial in soil for 60 days or a weight loss of at least about 30% after 15 days of exposure to a typical municipal composter. However, rates of biodegradation can vary widely depending on the type of degradable particles used, the remaining composition of the filter element, and the environmental conditions associated with the degradation test. U.S. Pat. No. 5,970,988 to Buchanan et al. and U.S. Pat. No. 6,571,802 to Yamashita provide exemplary test conditions for degradation testing.

Exemplary biodegradable materials include, without limitation, starch, cellulosic or other organic plant-derived fibrous materials (e.g., cotton, wool, cedar, hemp, bamboo, kapok, or flax), polyvinyl alcohol, aliphatic polyesters, aliphatic polyurethanes, cis-polyisoprene, cis-polybutadiene, polyhydroxyalkanoates, polyanhydrides, and copolymers and blends thereof. The term "aliphatic polyester" refers to polymers having the structure $—[C(O)—R—O]_n—$, wherein n is an integer representing the number of monomer units in the polymer chain and R is an aliphatic hydrocarbon, preferably a C1-C10 alkylene, more preferably a C1-C6 alkylene (e.g., methylene, ethylene, propylene, isopropylene, butylene, isobutylene, and the like), wherein the alkylene group can be a straight chain or branched. Exemplary aliphatic polyesters include polyglycolic acid (PGA), polylactic acid (PLA) (e.g., poly(L-lactic acid) or poly(DL-lactic acid)), polyhydroxy butyrate (PHB), polyhydroxy valerate (PHV), polycaprolactone (PCL), and copolymers thereof. These degradable (including biodegradable) materials may include, for example, any of the materials described in pending U.S. patent application Ser. No. 12/539,226, which is incorporated herein by reference.

Various degradable materials may be incorporated into a filter of the present invention in particulate form. The particle size of the degradable particles (e.g., starch particles) can vary, but is typically small enough to ensure uniform dispersion throughout the fibrous tow filter material without unduly affecting the desirable filtration and mechanical properties of the fibrous tow. As used herein, reference to "particles" or "particulate" materials simply refers to discrete units of relatively small size but does not restrict the cross-sectional shape or overall geometry of the material, which can be characterized as spherical, oblong, ovoid, flake-like, irregular or the like without departing from the invention. The degradable particles usually have a particle size range of about 100 nm to about 20 microns, more typically about 400 nm to about 800 nm, and most often about 400 nm to about 600 nm. In certain embodiments, the particle size of the degradable particles can be characterized as less than about 20 microns, less than about 800 nm, or less than about 600 nm. Certain embodiments of the degradable particles can be characterized as having a particle size of more than about 100 nm or more than about 400 nm.

The amount of degradable particles used in a filter element can vary, but typical weight percentages are in the range of about 5 to about 30% by weight, based on the overall dry weight of the filter element, more typically about 10 to about 20% by weight. In certain embodiments, the amount of degradable particles in the filter element can be characterized as more than about 5% by weight, more than about 10% by weight, or more than about 15% by weight, but less than about 60% by weight, less than about 50% by weight, or less than about 40% by weight.

In certain embodiments, the degradable particles (e.g., starch particles) are characterized as having certain solubility properties. For example, in certain applications, it may be desirable for the particles to have a high degree of solubility in water. In other embodiments, hydrophobicity (i.e., relatively low water solubility) may be desired. Many polymer materials, including starch materials, can be chemically modified in order to increase or reduce water solubility. In some embodiments, the particles can be viewed as highly soluble in water. In other embodiments, the particles have a low level of solubility in water and/or in certain other solvents, such as solvents used in the cellulose acetate fiber manufacturing process (e.g., the particles can be insoluble in acetone). As used herein, the term "soluble" refers to a material with a solubility in the given solvent of at least about 50 g/L, typically at least about 75 g/L, and often at least about 100 g/L at 25° C. A material characterized as "insoluble" refers to a material having a solubility in the given solvent of no more than about 5 g/L, typically less than about 2 g/L, and often less than about 0.5 g/L at 25° C.

The process for making filter elements according to the invention can vary, but a process for making cellulose acetate filter elements typically begins with forming cellulose fibers. The first step in conventional cellulose acetate fiber formation is esterifying a cellulose material. Cellulose is a polymer formed of repeating units of anhydroglucose. Each monomer unit has three hydroxyl groups available for ester substitution (e.g., acetate substitution). Cellulose esters may be formed by reacting cellulose with an acid anhydride. To make cellulose acetate, the acid anhydride is acetic anhydride. Cellulose pulp from wood or cotton fibers is typically mixed with acetic anhydride and acetic acid in the presence of an acid catalyst such as sulfuric acid. The esterification process of cellulose will often result in essentially complete conversion of the available hydroxyl groups to ester groups (e.g., an average of about 2.9 ester groups per anhydroglucose unit). Following esterification, the polymer is typically hydrolyzed to drop the degree of substitution (DS) to about 2 to about 2.5 ester groups per anhydroglucose unit. The resulting product is typically produced in flake form that can be used in subsequent processing.

To form a fibrous material, the cellulose acetate flake is typically dissolved in a solvent (e.g., acetone, methanol, methylene chloride, or mixtures thereof) to form a viscous solution. The concentration of cellulose acetate in the solution is typically about 15 to about 35 percent by weight. Additives such as whitening agents (e.g., titanium dioxide) can be added to the solution if desired. The resulting liquid is sometimes referred to as a liquid "dope." The cellulose acetate dope is spun into filaments using a solution-spinning technique, which entails extruding the liquid dope through a spinerette. The filaments pass through a curing/drying chamber, which solidifies the filaments prior to collection. The collected fibers are combined into a tow band, crimped, and dried. Conventional crimp ratios are in the range of 1.2 to 1.8. The fibers are typically packaged in bales that are suitable for later use in filter element formation processes.

The process of forming the actual filter element typically involves mechanically withdrawing the cellulose acetate tow from the bale and separating the fibers into a ribbon-like band. The tow band is subjected to a "blooming" process wherein the tow band is separated into individual fibers. Blooming can be accomplished, for example, by applying different tensions to adjacent sections of the tow band or applying pneumatic pressure. The bloomed tow band then passes through a relaxation zone that allows the fibers to contract, followed by passage into a bonding station. The bonding station typically applies a plasticizer such as triacetin to the bloomed fibers, which softens the fibers and allows adjacent fibers to fuse together. The bonding process forms a homogenous mass of fibers with increased rigidity. The bonded tow is then wrapped in plug wrap and cut into filter rods. Cellulose acetate tow processes are set forth, for example, in U.S. Pat. No. 2,953,838 to Crawford et al. and U.S. Pat. No. 2,794,239 to Crawford et al., which are incorporated by reference herein.

The processes for manufacturing filters in accordance with the present invention may be substantially similar to those processes. Each of the biodegradable polymers described herein may be processed in a manner known in the art to form filters (e.g. as tow fibers, fibers derived by fibrillating films, non-wovens formed by melt blown and wet laid processes). As described above, the fibers may be coated with cellulose acetate during or after formation. Alternatively, or in addition, they may be treated during assembly into the construction of filters (whether in individual form, multi-filter rods, or other construction formats known in the art).

Filter element components or segments for filter elements for multi-segment filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. No. 4,281,671 to Byrne; U.S. Pat. No. 4,862,905 to Green, Jr. et al.; U.S. Pat. No. 5,060,664 to Siems et al.; U.S. Pat. No. 5,387,285 to Rivers; and U.S. Pat. No. 7,074,170 to Lanier, Jr. et al. Other types of technologies for supplying filter materials to a filter rod-forming unit are set forth in U.S. Pat. No. 4,807,809 to Pryor et al. and U.S. Pat. No. 5,025,814 to Raker; which are incorporated herein by reference.

Cigarette filter rods can be used to provide multi-segment filter rods. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. No. 4,920,990 to Lawrence et al.; U.S. Pat. No. 5,012,829 to Thesing et al.; U.S. Pat. No. 5,025,814 to Raker; U.S. Pat. No. 5,074,320 to Jones, Jr. et al.; U.S. Pat. No. 5,105,838 to White et al.; U.S. Pat. No. 5,271,419 to Arzonico et al.; U.S. Pat. No. 5,360,023 to Blakley et al.;

U.S. Pat. No. 5,396,909 to Gentry et al.; and U.S. Pat. No. 5,718,250 to Banerjee et al; U.S. Pat. Appl. Pub. Nos. 2002/0166563 to Jupe et al., 2004/0261807 to Dube et al.; 2005/0066981 to Crooks et al.; 2006/0090769 to Woodson et al.; 2006/0124142 to Zhang; 2006/0144412 to Mishra et al., 2006/0157070 to Belcastro et al.; and 2007/0056600 to Coleman, III et al.; PCT Publication No. WO 03/009711 to Kim; PCT Publication No. WO 03/047836 to Xue et al.; all of which are incorporated herein by reference.

Multi-segment filter elements typically are provided from so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 4,850,301 to Greene, Jr. et al.; and U.S. Pat. No. 6,229,115 to Vos et al.; and U.S. Pat. Application Publication Nos. 2005/0103355 to Holmes, 2005/1094014 to Read, Jr., and 2006/0169295 to Draghetti, each of which is incorporated herein by reference.

Filter elements of the present invention can be incorporated within the types of cigarettes set forth in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,989,619 to Clearman et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,027,836 to Shannon et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,052,413 to Baker et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,396,911 to Casey, III et al.; U.S. Pat. No. 5,551,451 to Riggs et al.; U.S. Pat. No. 5,595,577 to Bensalem et al.; U.S. Pat. No. 5,727,571 to Meiring et al.; U.S. Pat. No. 5,819,751 to Barnes et al.; U.S. Pat. No. 6,089,857 to Matsuura et al.; U.S. Pat. No. 6,095,152 to Beven et al; and U.S. Pat. No. 6,578,584 to Beven; which are incorporated herein by reference. Still further, filter elements of the present invention can be incorporated within the types of cigarettes that have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000); which are incorporated herein by reference.

During manufacture of typical cigarette filters, two types of adhesives are commonly used to secure plug wrap and/or tipping paper around the filter material, and/or within the filter itself: (1) a hot melt adhesive for gluing the edges of the plug wrap, and (2) an aqueous dispersion based adhesive for gluing the tipping paper. Although the physical form of these adhesives may be different, both types typically include ethylene vinyl acetate as the main polymeric ingredient. Ethylene vinyl acetate is not generally considered a readily biodegradable polymer. In formulating cigarette filters for accelerated degradability (e.g., by employing structures disclosed herein, or forming a filter from polymers that have demonstrated accelerated biodegradability), it may be desirable that the adhesive that holds the fibers together within the two layers of paper are also biodegradable. Certain biodegradable adhesives may be used in cigarette filters as hot melts and as aqueous dispersions.

Commercially available biodegradable polymers that can be used directly as hot melts or used after blending with commonly used plasticizers and tackifiers include, for example, thermoplastic starches (e.g., Biograde polymers from Biograde Ltd., Biolice polymer from Limgrane, Biomax from DuPont, Bioplast from Biotec, Cereloy Bio polymer from Cerestech Inc., Getrex polymer from IGV, Grace Bio GB 100 polymer from Grace Biotech, Mater-Bi polymers from Novamont, Plantic polymers from Plantic, Re-New polymers from Starch Tech, Solanyl BP from Rodenburg Biopolymers); lends of thermoplastic starches and polyolefins (e.g., BioCeres polymers from FuturaMat, Biograde polymers from Biograde Ltd., Cereloy Eco from Cerestech Inc., CP-Bio PP from Cereplast); blends of thermoplastic starches and polyvinyl alcohol (e.g., Biograde WS from Biograde); blends of thermoplastic starches and biodegradable aliphatic polyesters (e.g., Biopar polymers from BiOP Polymer Technologies, Bioplast polymers from Biotec); and/or blends of thermoplastic starch and polylactic acid (e.g., CP-EXC, CP-INJ, and CP-TH series from Cereplast). Biodegradable polymers that may be applied as aqueous dispersions can be used as tipping glue after converting them to dispersions by one or more of several methods.

With a solvent-antisolvent approach, the polymer is first dissolved in a water miscible organic solvent. The precipitation of the polymer into dispersion is induced by mixing the solution with water. Another approach includes evaporative precipitation in to a dispersion, where the polymer is dissolved in an organic solvent which is not miscible with water, and the polymer solution is then sprayed into heated water resulting in an immediate evaporation of the organic solvent, which immediately forms the polymer particles are formed into a dispersion. During a wet ball milling process, micronized powder of the polymer is charged in to ball mill containing milling media (e.g., zirconium dioxide beads, silicium nitride beads, polystyrene beads) with an aqueous stabilizer, which is typically a surfactant. The moving milling media generates high shear forces and causes attrition of the original polymer particles to form a dispersion. High pressure homogenization is a process performed at room temperature with a piston gap homogenizer in an aqueous medium. During this process, a coarse suspension is formed through a very tiny homogenization gap. The particle size reduction to a dispersion is caused by cavitation forces, shear forces, and particle collision. During a microfluidics particle size reduction method, the polymeric material is subjected to ultra high shear forces to break down to smaller sizes that can be dispersed in water and stabilized with a surfactant. Another method uses supercritical fluid technology where a supercritical fluid such as $CO_2$ is used to effect a particle size reduction of the starting polymer that can then be dispersed into aqueous media. During a spray drying process, the polymer is first spray dried to obtain a powder and then dispersed and stabilized in water with a surfactant. These or other methods may be used to apply one or more of the biodegradable adhesives noted herein, or other adhesive(s) to secure tipping paper and/or plug wrap. The tipping paper and/or plug wrap thus secured may be more easily released to expose underlying filter materials to biodegradation or other degradation processes.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,131,416 to Gentry; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; and U.S. Pat. No. 6,904,917 to Kitao et al.; and U.S. Pat. Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al.; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Pat. Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Preferred cigarettes of the present invention will exhibit desirable resistance to draw. For example, an exemplary cigarette will exhibit a pressure drop of between about 50 and about 200 mm water pressure drop at 17.5 cc/sec. air flow. Preferred cigarettes exhibit pressure drop values of between about 60 mm and about 180, more preferably between about 70 mm to about 150 mm, water pressure drop at 17.5 cc/sec. air flow. Typically, pressure drop values of cigarettes are measured using a Filtrona Cigarette Test Station (CTS Series) available from Filtrona Instruments and Automation Ltd.

Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment of the invention.

We claim:

1. A filter material configured for use as part of a smoking article, comprising:

a plurality of bi-component fibers assembled as fibrous filter tow, each fiber including a core comprising a first degradable polymer material including polylactic acid or a polyhydroxyalkanoate and a sheath comprising a second polymer material including at least a cellulose ester and a plasticizer;

wherein the core comprises a higher melt temperature than the sheath; and wherein the second polymer material further comprises polylactic acid.

2. The filter material of claim 1, wherein the cellulose ester of the sheath comprises cellulose acetate.

3. The filter material of claim 1, wherein the core comprises at least about 60 percent to about 95 percent by volume of the bi-component fibers.

4. The filter material of claim 1, wherein the core comprises at least 80 percent by volume of the bi-component fibers.

5. The filter material of claim 1, further comprising tobacco material so as to form a smoking article.

6. The filter material of claim 1, where the core first degradable material consists of polylactic acid.

7. The filter material of claim 6, where the sheath comprises plasticized cellulose acetate.

8. A method of making filter material of claim 7, comprising coextruding the plasticized cellulose acetate with the polylactic acid core.

9. A method of making filter material of claim 7, comprising applying cellulose acetate solution together with a plasticizer onto core polylactic acid fiber.

10. A method of making filter material of claim 7, comprising applying cellulose acetate solution as a sheath onto core polylactic acid fiber and thereafter applying a plasticizer to the cellulose acetate sheath.

11. A filter material configured for use as part of a smoking article, comprising:

a plurality of bi-component fibers assembled as fibrous filter tow, each fiber including a core comprising a first degradable polymer material including polylactic acid or a polyhydroxyalkanoate and a sheath comprising a second polymer material including at least a cellulose ester and a plasticizer;

wherein the core comprises a higher melt temperature than the sheath; and where the second material further comprises a degradable material selected from the group consisting of polyhydroxypropionate, polyhydroxyvalaerate, polyhydroxybutyrate, polyhydroxyoctanoate, polylactic acid, polycaprolactone, polybutylene succinate adipate, polyvinyl alcohol, starch, polyesteramide, and regenerated cellulose.

12. The filter material of claim 11, wherein the core comprises at least about 60 percent to about 95 percent by volume of the bi-component fibers.

* * * * *